US005787656A

United States Patent [19]

D'Antonio

[11] Patent Number: 5,787,656

[45] Date of Patent: Aug. 4, 1998

[54] ACOUSTICAL SEATING RISERS FOR INDOOR ARENAS

[75] Inventor: Peter D'Antonio, Upper Marlboro, Md.

[73] Assignee: RPG Diffusor Systems, Inc., Md.

[21] Appl. No.: 784,390

[22] Filed: Jan. 17, 1997

[51] Int. Cl.[6] ..... E04F 11/00

[52] U.S. Cl. ..... 52/182; 52/144; 52/188; 181/285

[58] Field of Search ..... 52/182, 188–190, 52/144; 181/198, 285–286, 288, 290–291, 253

[56] References Cited

U.S. PATENT DOCUMENTS

| | | | |
|---|---|---|---|
| 3,393,481 | 7/1968 | Meuret | 52/188 |
| 3,813,831 | 6/1974 | Tate | 52/189 |
| 3,909,997 | 10/1975 | Eickhof | 52/188 |
| 3,981,112 | 9/1976 | Dake | 52/189 X |
| 4,516,368 | 5/1985 | Pichler | 52/188 X |
| 4,783,939 | 11/1988 | Bergmann et al. | 52/182 X |
| 4,821,839 | 4/1989 | D'Antonio et al. | 181/198 |
| 4,964,486 | 10/1990 | D'Antonio et al. | 181/285 |
| 5,014,475 | 5/1991 | Anderson et al. | 52/189 X |
| 5,027,920 | 7/1991 | D'Antonio et al. | 181/285 |
| 5,167,102 | 12/1992 | Nakatsubo et al. | 52/188 |
| 5,193,318 | 3/1993 | D'Antonio et al. | 52/144 |
| 5,226,267 | 7/1993 | D'Antonio et al. | 52/144 |
| 5,357,724 | 10/1994 | Sonoda | 52/182 |
| 5,479,746 | 1/1996 | Mannonen | 52/182 |
| 5,511,347 | 4/1996 | Schwarz | 52/182 |

FOREIGN PATENT DOCUMENTS

| | | | |
|---|---|---|---|
| 1373455 | 8/1964 | France | 52/188 |
| 2573796 | 5/1986 | France | 52/188 |
| 3905477 | 8/1990 | Germany | 52/188 |
| 290898 | 5/1928 | United Kingdom | 52/188 |

*Primary Examiner*—Beth Aubrey
*Attorney, Agent, or Firm*—H. Jay Spiegel

[57] ABSTRACT

Acoustical seating risers for indoor arenas are made of a plurality of pre-formed units of L-shaped cross-section. These L-shaped sections are mounted atop one another on a separate pre-formed foundation to provide a mounting platform for rows of seats and additional acoustical steps in the aisles. Each riser unit includes an integrally molded acoustical element having a slit and recessed chamber or a series of slits and recessed chambers designed to absorb low frequency sounds below 500 Hz, thus permitting balancing of the frequency response within that range. Riser units are assembled together in an overlapping fashion to form the sealed and slitted cavities and protect the recessed chamber or series of chambers from water or other contamination.

22 Claims, 9 Drawing Sheets

ACOUSTICAL SEATING RISERS FOR INDOOR ARENAS

BACKGROUND OF THE INVENTION

Today's indoor arenas and stadiums provide entertainment in many forms. Entertainment includes sports contests, exhibitions such as ice skating, rodeos and tractor pulls, music concerts including orchestral and rock music as well as graduation ceremonies for high schools and colleges.

Accordingly, arenas play major roles in the economic growth and well being of metropolitan areas. Since music and speech are important parts of events that occur in arenas and stadiums, research is ongoing seeking improvements in sound reinforcement systems and acoustics.

In recent years, significant improvements have occurred in loud speakers and sound reinforcement technology. These include improvements in clustering thereof and improvements have also been made in the quality of sound amplification including the use of virtual sound system design software using digital signal processors.

Progress in acoustical design has been hampered by several physical constraints. Since the program occurs on the floor level of the building and the audience encompasses additional floor area as well as a large portion of the wall area, the locations in the arena where acoustical treatments can be enhanced are limited. In a conventional arena, only the ceiling and a portion of the upper walls are available for acoustical treatment. Where acoustical treatments are proposed within reach of the audience, such acoustical treatments must not only perform their acoustical functions but must also be damage-proof and protected from abuse. In the typical covered stadium or arena, the roof is extremely large and is not designed to support significant additional weight loads over and above those anticipated such as, for example, through rain or snow. Therefore, only limited, lightweight, high frequency absorptive treatments can be effectively applied there.

One sound pattern that is especially annoying to an audience within an indoor arena or stadium is a heavy or "boomy" sound with excess reverberation in the low frequency region below 500 Hz. Sound problems below 500 Hz are further exacerbated by the extended low frequency performance of sound reinforcement systems. The extended low frequency energy delivered by sound reinforcement systems common in today's arenas and stadiums combined with the inability to architecturally absorb excess low frequency energy cause a sound problem. As such, a need has developed for an approach that can be employed to selectively absorb low frequency sound in the frequency range below 500 Hz employing the area where the audience sits.

SUMMARY OF THE INVENTION

The present invention relates to acoustical seating risers for indoor arenas and stadiums having at least a roof overhanging the seats thereof. The present invention includes the following interrelated objects, aspects and features:

(1) Almost 50% of the available surface area within an indoor arena is covered by the seating elements which consist of concrete risers, rows of seats attached to the risers, and concrete steps. Applicant has found that since a significant portion of the available surface area is devoted to the concrete risers, appreciable absorption could be obtained if one could devise a method to provide low frequency absorption using the concrete risers as the sound absorbing elements.

(2) In the present invention, the concrete risers are formed with acoustical treatments designed to absorb low frequency sound below 500 Hz. In particular, the concrete seating risers include riser units of L-shaped cross-section. Each riser unit has a horizontally disposed portion and a vertically disposed portion with adjacent riser units being stacked upon one another with an end of the horizontally extending portion sitting on top of the top of the vertically extending portion of the unit sitting below it.

(3) The top of the vertically extending portion defines a horizontal surface in which one or more chambers, cavities or recesses are formed from one side to the other side extending therealong. If desired, a single elongated chamber, cavity or recess may be provided or, alternatively, spaced adjacent sub-chambers, sub-cavities or sub-recesses may be employed.

(4) In the preferred embodiment, the top wall of the vertically extending portion of each riser unit has a tapered portion forward of the chamber or sub-chambers that both allows entry of air particles and permits drainage of undesirable substances such as water. In this regard, water is commonly used to clean riser sections. This feature precludes material amounts of water from entering the acoustical chambers.

(5) As sound passes through a narrow slit formed between the top wall of the vertical portion of a riser unit and the overlying bottom surface of the horizontally extending portion of the next upwardly extending riser unit, the air mass located within the slit is set into vibration as against the "spring action" of air within the recess or cavity, thus creating a low frequency resonance condition. This low frequency resonance condition removes energy from the system and provides low frequency absorption.

Additionally, step units may be provided to allow regions of consecutive riser units to be used as a series of steps allowing patrons to descend and ascend the riser units to and from their seats. Each step unit may include a chamber accessed through a slit extending across a face of the step unit to provide the same sound absorption as described in paragraph (5) above.

Accordingly, it is a first object of the present invention to provide acoustical seating risers for indoor arenas and stadiums.

It is a further object of the present invention to provide such seating risers including chambers, recesses or cavities for absorbing low frequency sounds.

It is a yet further object of the present invention to provide such seating risers wherein the chambers, recesses or cavities thereof are hidden from view to prevent tampering and contamination.

It is a still further object of the present invention to provide such seating risers with ramp structures allowing drainage of water to prevent contamination of acoustical features thereof.

It is a yet further object of the present invention to provide the slits and recesses or cavities thereof either continuously along a riser unit or to provide a series of short, consecutive slits and recesses or cavities therealong.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 2:
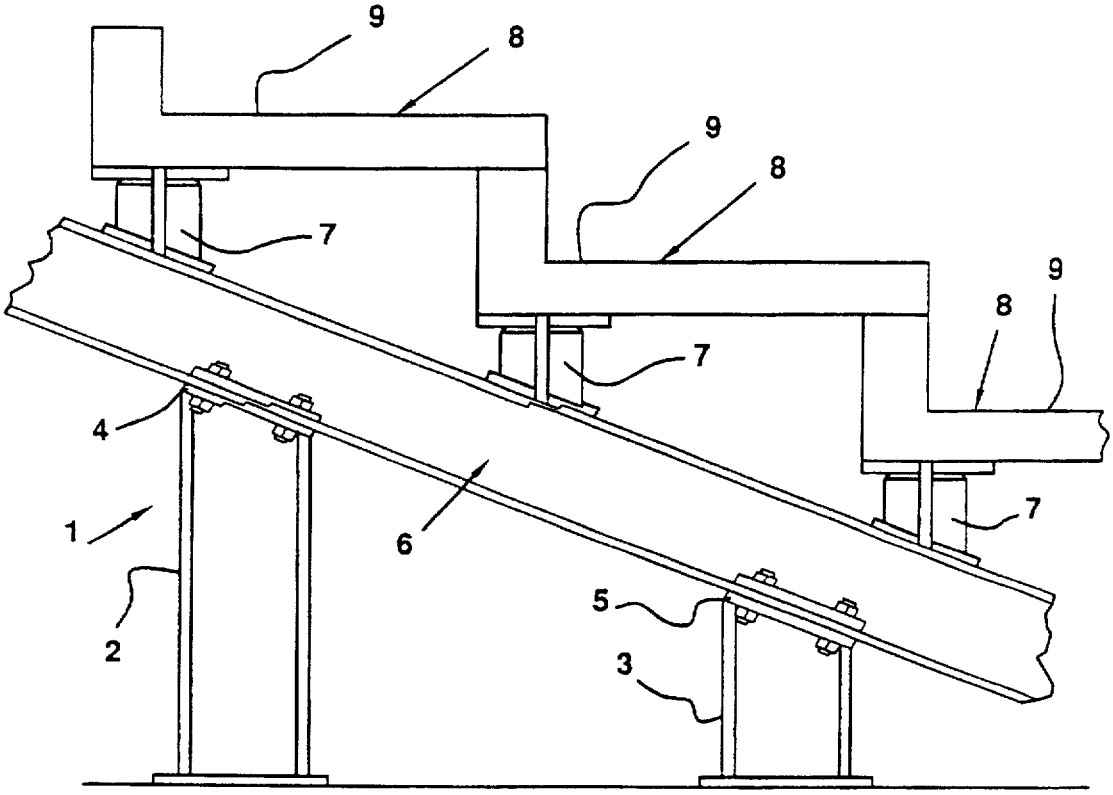
FIG. 2 PRIOR ART
FIG. 2 shows a conventional seating riser devoid of acoustical treatments.

With reference, first, to FIG. 2, a conventional seating riser devoid of acoustical treatments is generally designated by the reference numeral 1 and is seen to include supports 2, 3 having respective angled top surfaces 4, 5 facilitating attachment of an elongated stringer 6 in the form of an I-beam to which are affixed mounting blocks 7. Elongated riser units 8 having surfaces 9 are mounted on the mounting blocks 7. Rows of seats are mounted on the surfaces 9. Typically, the riser units 8 are made of pre-cast or prestressed concrete made, as shown, in L-shaped sections. As pointed out hereinabove, the riser system 1 is devoid of acoustic treatments.

Figure 1:
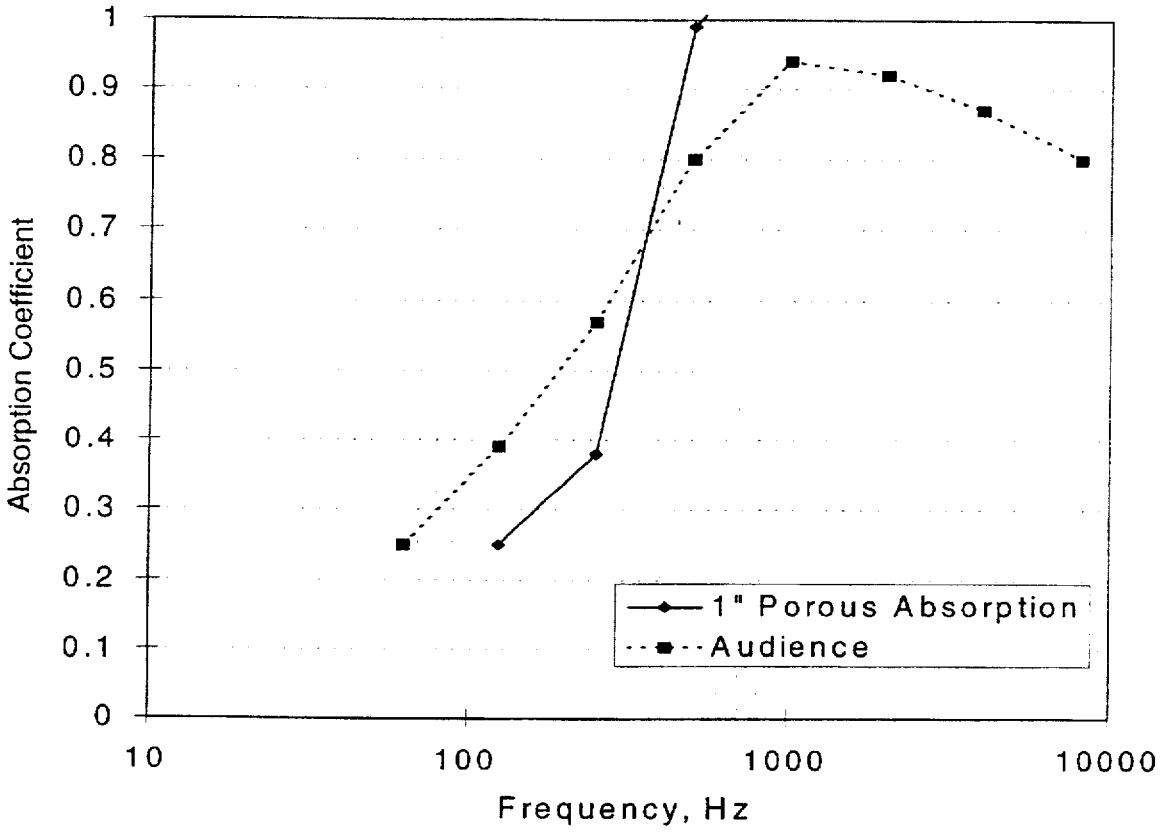
FIG. 1 depicts a graph of absorption coefficient versus frequency and illustrates how absorption efficiency of porous absorption and audience absorption decreases below 500 Hz.

With reference to FIG. 1, below 500 Hz, the sound absorbing efficiency of the audience itself as well as porous sound absorbers commonly used in covered stadiums and indoor arenas such as, for example, fiberglass and mineral wool, are diminished. Such porous absorbers and the audience are more efficient at absorbing frequencies in the mid to high range. Thus, in a typical covered stadium or indoor arena having risers such as illustrated in FIG. 2, when mid and high frequencies are absorbed by the audience and porous absorbers, the sounds that remain (that are unabsorbed) typically comprise a heavy bass or "boomy" sound with excess reverberation in the low frequency region below 500 Hz. As explained in the BACKGROUND OF THE INVENTION, the extended low frequency energy delivered by today's sound reinforcement systems combined with the typical inability to architecturally absorb excess low frequency energy cause sound problems in indoor arenas and covered stadiums.

With reference to FIGS. 3–7, the present invention is generally designated by the reference numeral 20 and includes supports 21, 23, having respective angled top surfaces 25 and 27, which top surfaces support an angularly disposed I-beam 29 having a bottom surface 31 affixed to the top surfaces 25 and 27, and an upper surface 33 to which are affixed a series of mounting blocks 35 on which are mounted elongated riser units 40, each having a horizontal portion 41 with a flat upper surface 43 adapted to support a row of seats, and a vertically extending portion 45 having a top surface 47 adapted to support a bottom surface 49 of the next upper riser unit 40. Of course, as best seen with reference to FIG. 4, each riser unit 40 is elongated to support elongated rows of seats and, as should be well understood, each series of riser units 40 is supported by a plurality of spaced sets of supports 21, 23, 29 and blocks 35.

Figure 3:
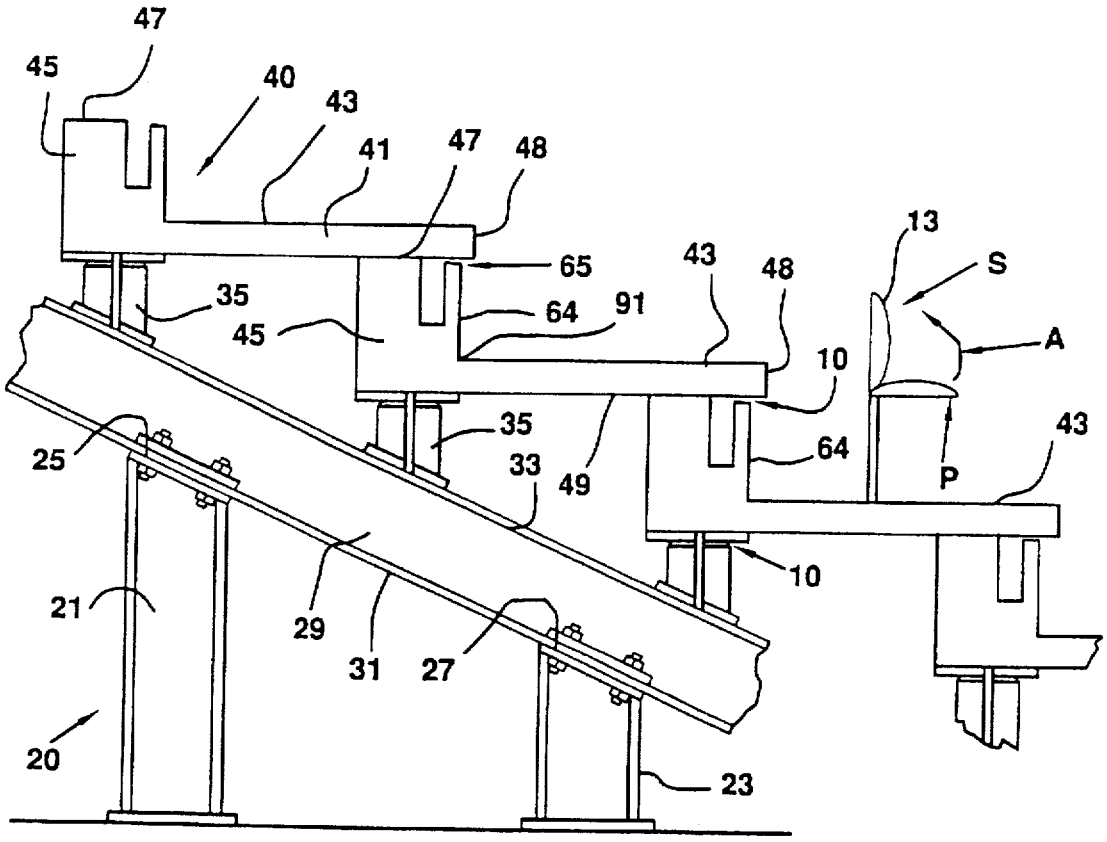
FIG. 3 shows a side view of an acoustical seating riser in accordance with the teachings of the present invention.
Figure 4:
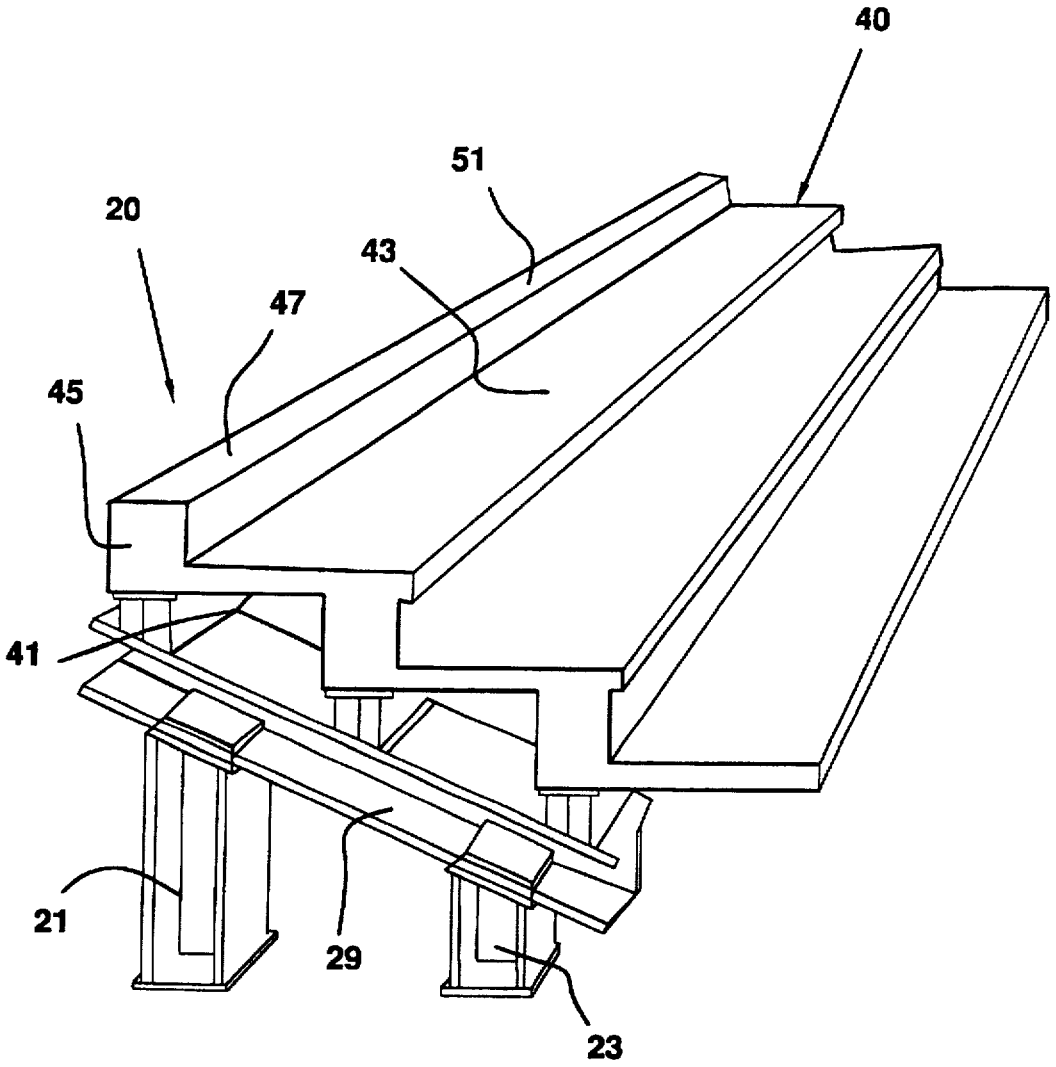
FIG. 4 shows an isometric view of the riser illustrated in FIG. 3.
Figure 5:
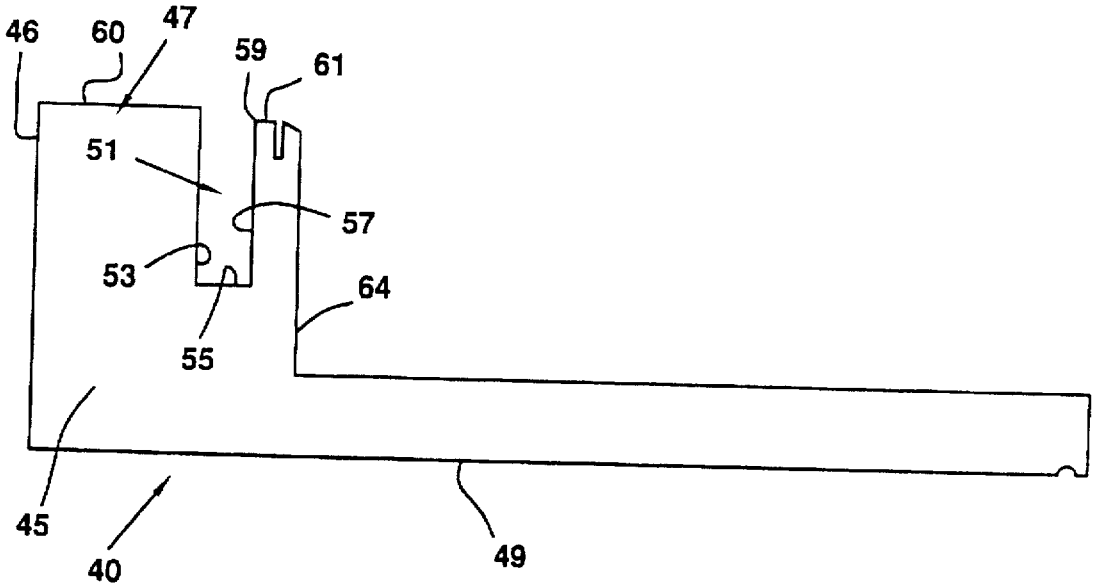
FIG. 5 shows a side schematic view of a single riser unit made in accordance with the teachings of the present invention.

With reference, now, to FIG. 5, a cross-sectional view of one riser unit 40 is enlarged as compared to FIGS. 3 and 4 to show detail. The riser unit 40 has a generally uniform cross-section. With particular reference to the top surface 47 of the vertically extending portion 45, it is seen that forward of the rear wall 46 thereof, a chamber 51 is provided that has a generally rectangular cross-section including a rear wall 53, a bottom wall 55, and a forward wall 57 extending upwardly to a point of termination defining a rear edge 59 of a top wall portion 61. As should now be understood, the top wall 47 consists of a top wall portion 60 and a top wall portion 61 that are parallel to one another with the top wall portion 60 being slightly higher in elevation. As should be understood, with reference back to FIG. 3, the slight spacing between the elevations of the wall portions 60 and 61 allows the formation of a passage or slit 65 between the bottom wall 49 of the horizontal portion 41 of the riser unit 40 and the top wall portion 61 allowing air to gain access to the chamber 51. In one example of the present invention, although not considered in any way limiting, the slit 65 may have a height of approximately 0.375 inches.

Figure 6:
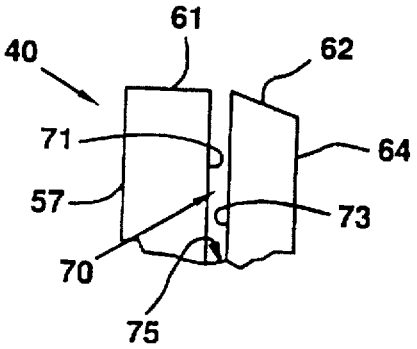
FIG. 6 shows an enlarged view of a portion of the structure illustrated in FIG. 5.

With reference to FIG. 6, the riser unit 40 may have a further chamber 70 that extends downwardly from the top wall portion 61 and includes side walls 71, 73, and a bottom wall 75. Additionally, forward of the further chamber 70, the top wall portion 61 of the riser unit 40 has a sloped portion 62 extending to intersection with the forward wall 64 of the vertical portion 45. The sloped portion 62 is provided to best facilitate drainage of water or other debris that might accidentally or inadvertently enter the slit 65.

With reference back to FIG. 4, it is seen that the chamber 51 depicted in FIGS. 3 and 5, in particular, may be one of a plurality of laterally spaced sub-chambers extending across the top surface 47 of the vertical portion 45 of each riser unit 40. Alternatively, if desired, the chamber 51 may comprise a continuous chamber extending entirely or substantially entirely across the top surface 47 of the vertical portion 45 of each riser unit 40. Similarly, the further chamber 70 may be continuous across the riser unit 40 or may comprise a plurality of laterally spaced recesses.

Figure 7:
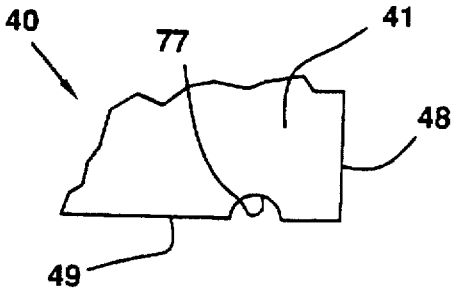
FIG. 7 shows a further enlarged view of a portion of the structure illustrated in FIG. 5.

With reference to FIG. 7, the bottom wall 49 of the horizontal portion 41 of the riser unit 40 may be provided with an elongated recess 77 of arcuate cross-section slightly spaced from the forward wall 48 of the horizontal portion 41 and which overlies the recess 70. As best seen in FIG. 3, the forward surface 48 of the horizontal portion 41 of each riser unit extends slightly forward of the forward wall 64 of the next lower riser unit 40 to provide a slight overhang to help conceal the slit 65 and also to help deter entry of liquids into the slit 65. As should be understood, the engaging portions of respective surfaces 49 and 47 are suitably sealed through the use of resilient sealants and adhesives to ensure an air-tight seal between each riser unit 40 so that the only access provided for air particles into each chamber 51 is via each respective slit 65.

Figure 10:
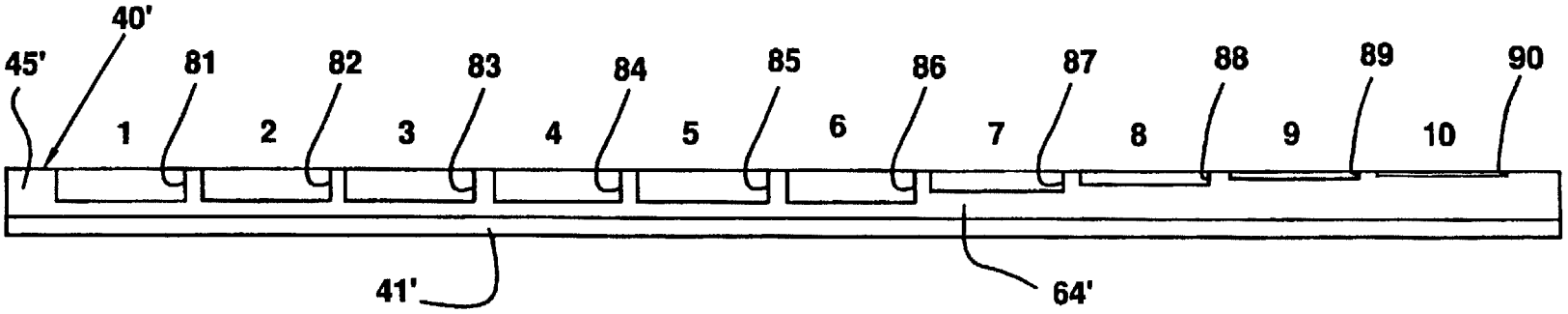
FIG. 10 shows a cross-sectional view along the line 10—10 of FIG. 3.
Figure 11:
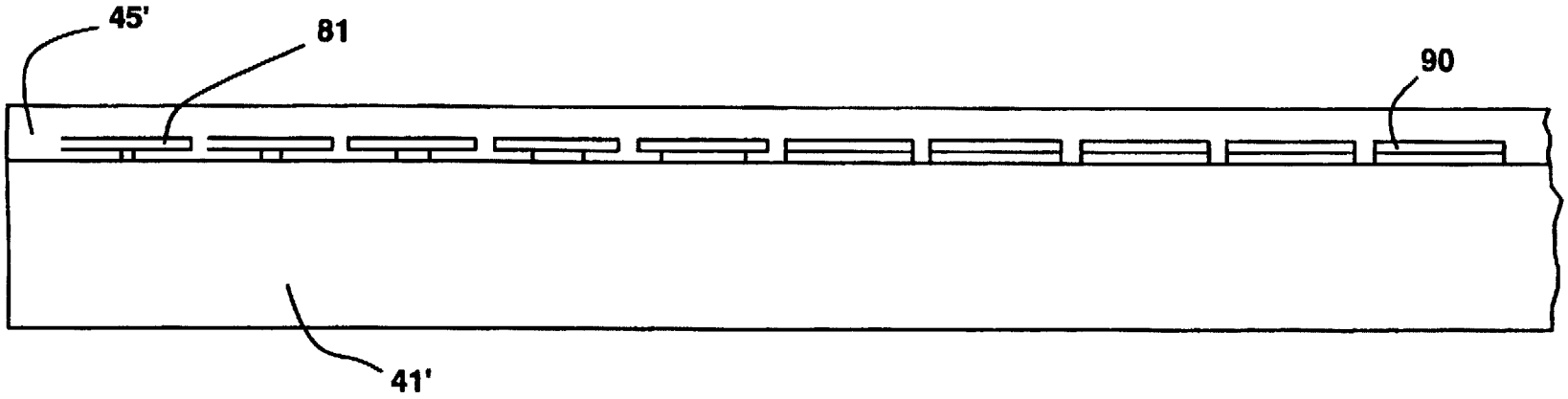
FIG. 11 shows a top view of one of the riser units of FIG. 3.

FIGS. 10 and 11 show a variation consisting of a riser unit 40' having a horizontal portion 41' and a vertical portion 45'. Sub-chambers 81–90 are shown in phantom in FIG. 10 through the wall 64' and are seen to comprise sub-chambers 81–86 of equal depth with sub-chambers 87, 88, 89 and 90 having successively decreasing respective depths. FIG. 11 shows the sub-chambers 81–90 to have equal lengths and widths. Slit width and height may also be varied to achieve a desired resonant frequency.

Low frequency absorption takes place according to the principles of the "Helmholtz" resonator developed by Ferdinand von Helmholtz in the early 18th century. The resonant chamber 51 consists of a cast internal cavity in the concrete riser unit 40. The forward section of the cavity, the neck plate, incorporates a rectangular neck opening, which forms a slit 65 when the upper tread section is placed over it. As sound passes through the neck slit into the internal cavity, the air mass in the neck is set into vibration against the spring action of the air in the cavity. Thus a low frequency resonance condition is established. This resonance removes energy from the system and provides low frequency sound absorption. Numerous approaches may be employed to increase the efficiency of absorption in resonators in accordance with the teachings of the present invention to broaden the bandwidth of their resonance. One approach is to place a porous absorber panel in the cavity at the exit of the slit 65. Another approach comprises placing a vertical slot 70 (FIG. 6) in the neck plate, into which a limp resistive foil may be inserted. This design broadens the resonance.

Figure 8:
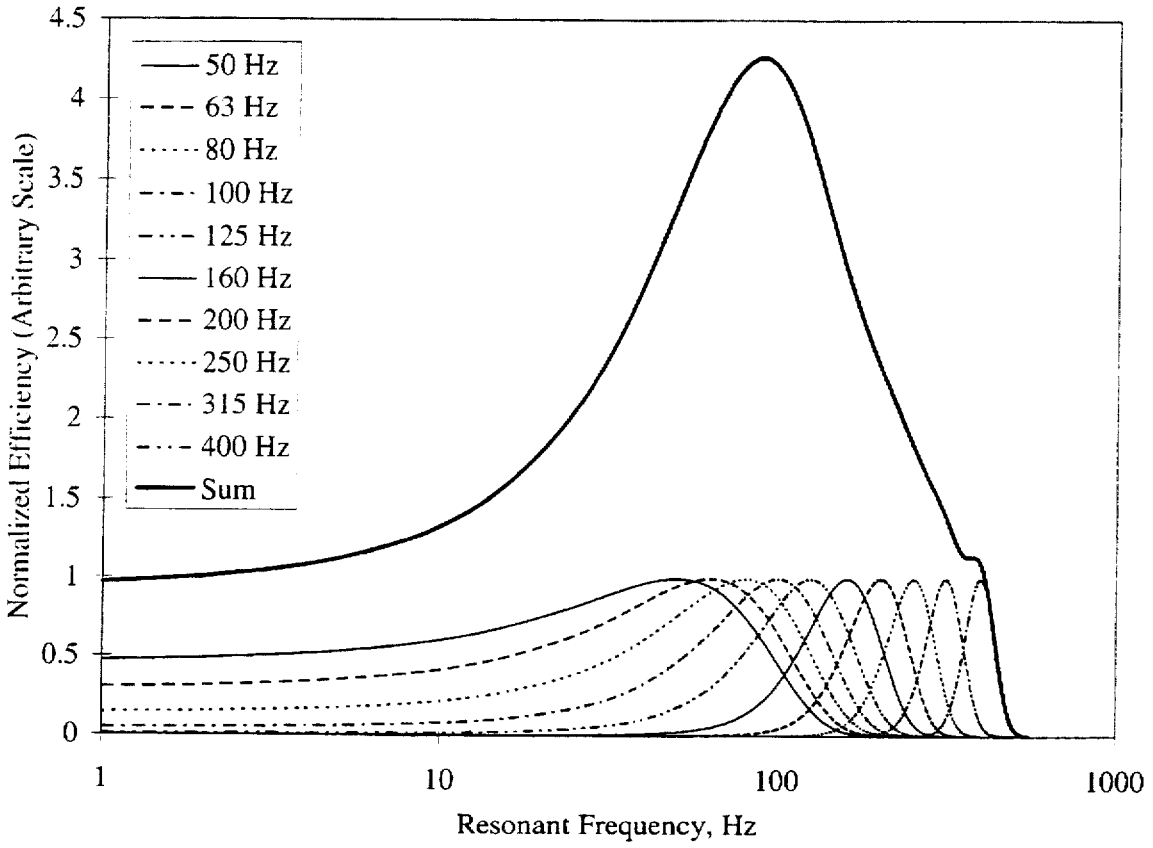
FIG. 8 shows a graph of normalized efficiency versus resonant frequency depicting individual overlapping resonators normalized to 1 and their sum.

FIGS. 10 and 11, already described above, illustrate another approach that provides broad bandwidth absorption to provide overlapping resonators tuned for maximum absorption efficiency at specific ⅓rd octave center frequencies. Thus, the desired frequency range is covered by providing 10 distinct resonator cavities 81–90 that respectively resonate at 50, 63, 80, 100, 125, 160, 200, 250, 315 and 400 Hz. overlapping resonator efficiency, normalized to 1, and their sum for the cavities of FIGS. 10 and 11, are shown in FIG. 8.

A formula to predict the resonant frequency, $f_c$, of a classically shaped Helmholtz absorber is given in Equation (1). The absorber consists of a cavity volume, V, of arbitrary size and a long narrow neck of length l and circular cross-section A, like a chemistry flask. The classical theory uses the radiation impedance of the plug of air in the neck. This is analogous to a piston moving in an infinite baffle. This radiation impedance can be derived analytically and gives an end correction, k, of 0.85 a, where "a" is the radius of the circular neck cross-section. Since this end correction needs to be applied to both ends of the neck, k=1.7 a. The constant c is the speed of sound, which is 340 m/sec.

$$f_c = \frac{c}{2\pi}\sqrt{\frac{A}{(l+k)V}} \tag{1}$$

The end correction has not been determined when the slit has a rectangular instead of circular cross-section. Thus, we need to know the radiation impedance of a slit. This can be determined using a boundary element method analysis or more simply by relating the rectangular cross-sectional area to an equivalent radius, a, for the circular cross-section. The new expression for k when a slit is used is given in Equation (2).

$$k = 1.7\sqrt{\frac{A}{\pi}} \tag{2}$$

To verify this predictive formula for $f_c$, we can experimentally measure the resonant frequency by inserting a microphone in the cavity to determine the frequency response. This was accomplished using a maximum length sequence exciting signal generated by a Techron TEF 20 analyzer and a GLM 100 pressure zone microphone inside the cavity.

TABLE 1

An example of the design parameters in a typical acoustical riser.

| $F_c$ | CD | CW | CH | ND | NW | NH |
|---|---|---|---|---|---|---|
| 50.05934 | 3.00 | 28.80 | 8.00 | 1.50 | 2.97 | 0.375 |
| 63.04017 | 3.00 | 28.80 | 8.00 | 1.50 | 4.71 | 0.375 |
| 80.07809 | 3.00 | 28.80 | 8.00 | 1.50 | 7.60 | 0.375 |
| 99.99219 | 3.00 | 28.80 | 8.00 | 1.50 | 11.85 | 0.375 |
| 125.0725 | 3.00 | 28.80 | 8.00 | 1.50 | 18.54 | 0.375 |
| 160.0395 | 3.00 | 28.80 | 7.59 | 1.50 | 28.80 | 0.375 |
| 200 | 3.00 | 28.80 | 4.86 | 1.50 | 28.80 | 0.375 |
| 250.0161 | 3.00 | 28.80 | 3.11 | 1.50 | 28.80 | 0.375 |
| 314.9344 | 3.00 | 28.80 | 1.96 | 1.50 | 28.80 | 0.375 |
| 400.8256 | 3.00 | 28.80 | 1.21 | 1.50 | 28.80 | 0.375 |

In Table 1, CD, CW, CH, ND, NW and NH refer to the cavity depth, cavity width, cavity height, neck slit depth, neck slit width and neck slit height, respectively. There are numerous other combinations of these variables which could work equally well as should be understood by those skilled in the art.

A loudspeaker was placed 1 meter from a test cavity with dimensions listed in Table 1 for an $f_c$ of 80 Hz. The frequency response with the slit closed was also measured for normalization of the measurement. This normalization removes the frequency response of the test loudspeaker and microphone used. An example of the resonant chamber and reference measurement at 80 Hz is shown in FIG. 9.

Figure 9:
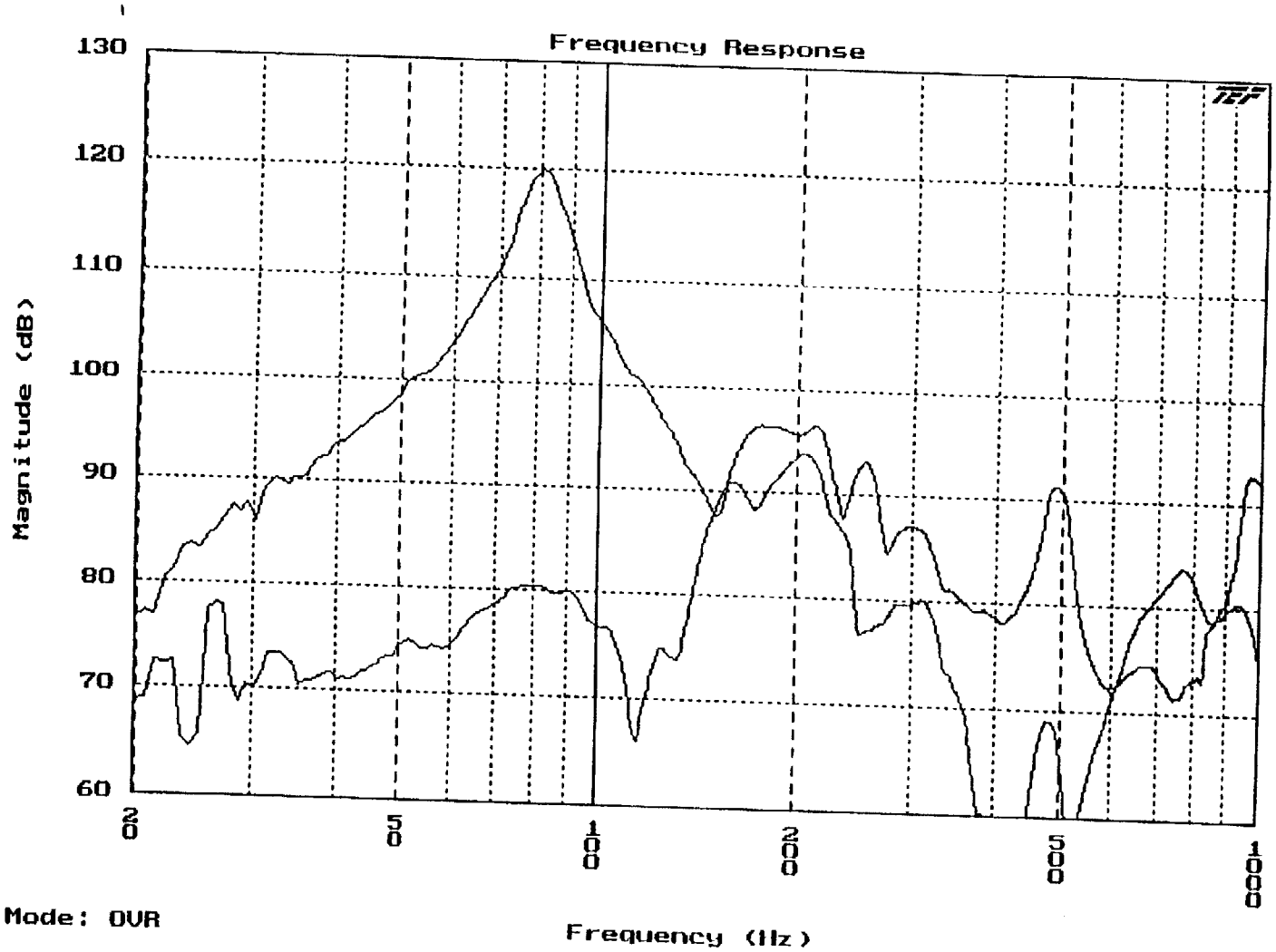
FIG. 9 shows a graph of sound magnitude versus frequency depicting experimental measurement of 80 Hz resonance in an acoustical cavity made in accordance with the teachings of the present invention.

FIG. 9 also indicates the agreement between the predicted and measured resonant frequency using the approximate end correction described previously.

Thus, Applicant has devised a series of adjacent resonators (FIGS. 10 and 11) configured along the length of a typical acoustical riser as indicated in the isometric view of FIG. 4 (reference numeral 51) and the more detailed view in FIGS. 10 and 11.

Figure 12:
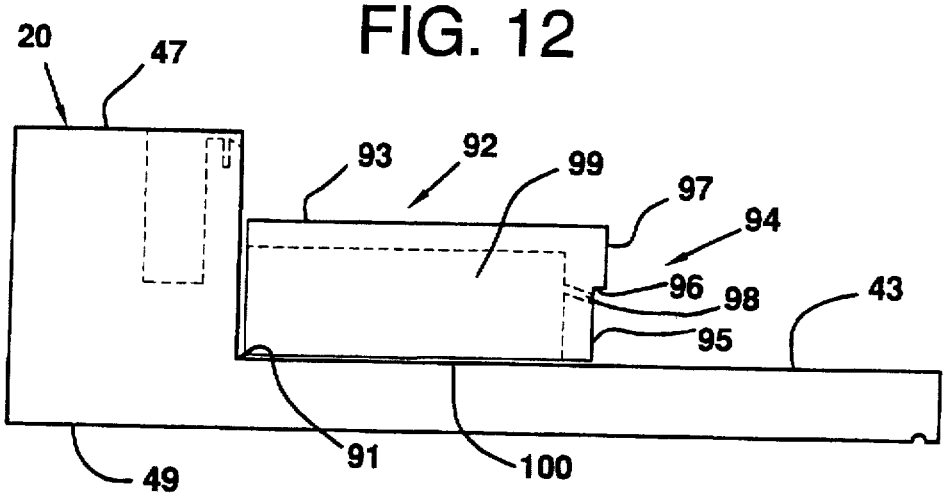
FIG. 12 shows a side view of a step unit of the present invention.

With reference back to FIG. 3, it should be recognized that the riser unit 20 is used, not only to provide support for rows of seats but also to provide areas that comprise steps allowing patrons to ascend and descend to and from their particular seats. In FIG. 3, the reference numeral 91 refers to a corner between the horizontal surface 43 and the vertical surface 64 where a step unit may be placed to provide the appropriate rise and run dictated by local codes for public steps. In this regard, with reference to FIG. 12, a riser unit 20 is shown and the corner 91 is identified. The step unit 92 includes a horizontal surface 93 and a vertical surface 94 consisting of a lower vertical surface 95, an upper vertical surface 97 parallel with the lower vertical surface 95, and a horizontal surface 96 therebetween that overhangs the lower vertical surface 95. A slit 98 is provided just below the horizontal surface 96 and it extends at a slight upward angle as seen in FIG. 12 to a chamber 99 formed within the step unit 92.

Figure 13:
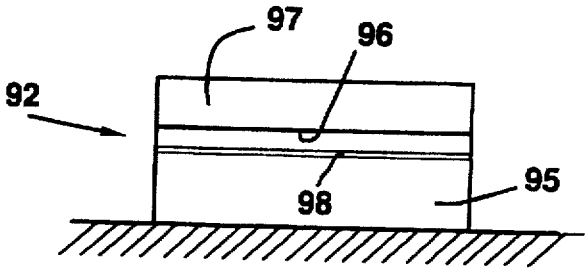
FIG. 13 shows a front view of the step unit of FIG. 12.

With reference to FIG. 13, it is seen that the slit 98 may extend completely across the front surface 94 of the step unit 92. The upward angle of the slit 98 from the lower front surface 95 to the chamber 99 is provided to facilitate draining of any liquids that might inadvertently enter the slit 98. The horizontal surface 96 provides an overhang to provide further protection for the slit 98.

The step unit has a lower surface 100 that sits on the horizontal surface 43 of the riser unit 20 so that a user may step onto the horizontal surface 43, onto the top surface 93 of the step unit 92, and thence onto the horizontal surface 47 of the riser unit 20 which steps should be of substantially equal heights. Of course, a multiplicity of step units 92 are sequentially installed in the manner described in FIGS. 12 and 13 to provide a long run of steps from one level of an indoor arena or covered stadium to another level thereof.

The step unit 92 provides additional low frequency absorption over and above that which is supplied by the riser units 20. In the same manner described above, concerning the riser units 20, as sound passes through the narrow slit 98, the air mass located therein is set into vibration as against the spring action of air within the chamber 99, thus creating a low frequency resonance condition that removes energy from the system and provides low frequency sound absorption.

As such, an invention has been disclosed in terms of preferred embodiments thereof which fulfill each and every one of the objects of the invention as set forth hereinabove and provide a new and useful acoustical seating riser for indoor arenas of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. An acoustical seating riser unit adapted to support a plurality of seats, comprising:

a) an elongated body having a length and a generally uniform L-shaped cross-section;

b) said body having a horizontal portion having a top surface, a front surface defining a forward termination thereof and a bottom surface;

c) said body having a vertical portion extending upwardly from said horizontal portion at an end thereof remote from said front surface, said vertical portion having a top surface defining an upward termination thereof, a front surface and a rear surface;

d) an acoustical treatment integrally formed in said body and comprising a chamber formed in said vertical portion having an upwardly facing opening and extending downwardly from said top surface of said vertical portion; and e) a cover overlying and engaging said top surface of said vertical portion, said cover and said top surface of said vertical portion defining, therebetween, an open horizontally elongated slit providing ambient air access to said chamber.

2. The unit of claim 1, wherein said chamber has a rectangular cross-section.

3. The unit of claim 1, wherein said chamber extends substantially the length of said body.

4. The unit of claim 1, wherein said chamber comprises a plurality of spaced sub-chambers aligned with one another and extending along said length.

5. The unit of claim 1, wherein said top surface of said vertical portion comprises a first portion rearward of said chamber with respect to said vertical portion front surface and a second portion forward of said chamber with respect to said vertical portion rear surface.

6. The unit of claim 5, wherein said first and second portions lie in parallel spaced planes.

7. The unit of claim 6, wherein said first portion is higher than said second portion with respect to said bottom surface of said horizontal portion.

8. The unit of claim 6, wherein said chamber comprises a first chamber, and said riser unit further including a second chamber formed in said vertical portion and extending downwardly from said second portion.

9. The unit of claim 5, wherein said second portion has a forward surface angled downwardly in a direction away from said chamber.

10. The unit of claim 1, said body being made of concrete.

11. A plurality of said riser units in accordance with claim 1, mounted together in cascading configuration to form a riser, said plurality of riser units including at least an upper riser unit and a lower riser unit, said upper riser unit having said horizontal portion with said bottom surface comprising said cover and resting on said top surface of said vertical portion of said lower riser unit.

12. The riser of claim 11, wherein said front surface of said upper riser unit horizontal portion is forward of said front surface of said lower riser unit vertical portion with respect to said rear surface of said lower riser unit vertical portion.

13. The riser of claim 12, wherein each riser unit has said vertical portion top surface having a first portion rearward of said chamber formed in said top surface, with respect to said vertical portion front surface and a second portion forward of said chamber with respect to said vertical portion rear surface.

14. The riser of claim 13, wherein said first and second portions of each riser unit lie in parallel spaced planes.

15. The riser of claim 14, wherein said first portion is higher than said second portion with respect to said bottom surface of said horizontal portion of each riser unit.

16. The riser of claim 15, wherein said second portion has a forward surface angled downwardly in a direction away from said chamber with respect to said rear surface of said vertical portion.

17. The riser of claim 15, wherein each riser unit has said chamber comprising a first chamber, and said unit further including a second chamber formed in said vertical portion and extending downwardly from said second portion toward said bottom surface of the horizontal portion.

18. The riser of claim 17, wherein said bottom surface of said horizontal portion of said upper riser unit has a recess aligned above said second chamber in said lower riser unit with respect to said bottom surface of said horizontal portion of said lower riser unit.

19. The riser unit of claim 1, further including a step unit having a front surface and a rear surface and mounted on said horizontal portion top surface and said rear surface of said step unit lying adjacent said vertical portion front surface, said step unit having an internal chamber and a slit extending rearwardly with respect to and from an opening in said front surface of said step unit to said step unit internal chamber.

20. A step unit for a seating riser comprising a generally rectangular cubic body, a substantially flat top surface and a front wall having a front surface, said body having an internal chamber and a slit below said top surface and extending from an opening in said front surface through said front wall to said chamber.

21. An acoustical seating riser un it comprising:

a) an elongated body having a length and a height;

b) said body having a vertical portion extending upwardly and having a top surface defining an upward termination thereof, a front surface and a rear surface;

c) an acoustical treatment integrally formed in said body and comprising a chamber formed in said vertical portion and defining a volume $V_1$; and d) a passage connecting said chamber with atmospheric air, said passage defining a volume $V_2$ smaller than said volume $V_1$, whereby air mass in said passage is set into vibration against spring action of air in said chamber responsive to entry of soundwaves into said passage whereby sound is absorbed in said chamber.

22. The unit of claim 21, wherein said chamber has an upper opening, and a cover overlying and engaging said top surface of said vertical portion, said cover and said top surface of said vertical portion defining, therebetween, said passage.

* * * * *